US006193437B1

(12) United States Patent
Heims

(10) Patent No.: US 6,193,437 B1
(45) **Date of Patent: *Feb. 27, 2001**

(54) PAVER HAVING AN IMPROVED MATERIAL HOPPER AND LOADER FOR SAME

(75) Inventor: Dirk Heims, Bad Münder (DE)

(73) Assignee: ABG Allgemeine Baumaschinen Gesellschaft mbH, Hameln (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/310,492

(22) Filed: May 12, 1999

(30) Foreign Application Priority Data

May 12, 1998 (DE) ..... 198 21 090

(51) Int. Cl.[7] ..... E01C 19/18
(52) U.S. Cl. ..... 404/110; 404/101; 404/108
(58) Field of Search ..... 404/101, 108, 404/110, 118; 298/24, 25

(56) References Cited

U.S. PATENT DOCUMENTS 3,997,277 * 12/1976 Swisher, Jr. et al. ..... 404/84.05
5,529,434 * 6/1996 Swisher, Jr. ..... 404/108
5,735,634 * 4/1998 Ulrich et al. ..... 404/102

FOREIGN PATENT DOCUMENTS 26 28 325 1/1978 (DE) .
296 12 034 U 9/1996 (DE) .

* cited by examiner

*Primary Examiner*—Eileen D. Lillis
*Assistant Examiner*—Gary S. Hartmann
(74) *Attorney, Agent, or Firm*—Mark A. Ussai

(57) ABSTRACT

A paver and a corresponding loader each have a chassis (1) which is provided, at the front in the paving direction, with a hopper (8) for receiving material to be paved and, at the rear, with a floating screed (4), a longitudinal conveyor device (7) being provided between the hopper (8) and a distributor auger (6) located in front of the screed (4) in the paving direction, the hopper (8) being open towards the longitudinal conveyor device (7) and including two hopper halves (9) which are each pivotable about an axis (21) extending adjacently to the longitudinal conveyor device (7) in the paving direction. Further, in each of the hopper halves (9) is provided a lateral conveyor device (12) which is drivable by a drive (13), is arranged on the bottom side and extends as far as the longitudinal conveyor device (7), those bottom portions (14, 19) of the hopper halves (9) which remain with regard to the respective lateral conveyor device (12) being tiltable relative to the lateral conveyor device (12).

21 Claims, 2 Drawing Sheets

PAVER HAVING AN IMPROVED MATERIAL HOPPER AND LOADER FOR SAME

The present invention relates to paving machines, and more particularly to paving machines having a hopper for receiving paving material from a loading vehicle.

Paving machines or "pavers" generally include a front-mounted hopper for receiving paving material and a rear-mounted screed which floats on the material to be paved. The screed is articulated on the chassis of the paver via tension arms. Paving material is deposited into the hopper by a separate "loading" vehicle and is conveyed from the hopper by means of a longitudinal conveyor device to a distributor auger located in front of the screed. The material is distributed over the paving width by the distributor auger and is paved or leveled by means of the screed.

The loading vehicle is placed in front of the paving vehicle and is pushed by the paver until all the material to be paved has been emptied into the hopper. The loading vehicle is then exchanged with another loading vehicle having a full load of paving material.

Generally, when the course to be paved, such a roadway, an airport runway, etc., is relatively wide and/or is desired to have a relatively large finished thickness, the quantity of paving material in the hopper is insufficient to ensure that the paver is supplied continuously with an adequate amount of paving material. Due to insufficient supply of material, the paving vehicles must be frequently changed, therefore causing production interruptions that significantly increase the overall time for laying a course of paving material.

One known method to avoid such production interruptions is to use a loading vehicle with a very large hopper and a conveyor connected with the paving machine. Generally, other loading vehicles are used to supply the "fixedly" connected loading vehicle. This type of loading system clearly requires a considerable additional outlay in terms of personnel and machinery.

It would be desirable to have a paving system in which production interruptions occurring due to a change of loading vehicles transporting the material to be paved are avoided.

SUMMARY OF THE INVENTION

In one aspect, the present invention is a paver with a longitudinal conveyor device conveying to a distributor auger and with a hopper comprising two hopper halves, a transverse or lateral conveyor device drivable by a drive system and disposed in each of the hopper halves, with bottom or base portions of each hopper half adjacent to each lateral conveyor device being tiltable relative to or toward the respective lateral conveyor device. Each lateral conveyor device extends from the outer edge of the respective hopper half to the longitudinal conveyor device. This hopper structure enables two loading vehicles to be simultaneously placed in front of the paver, with one loading vehicle in front of each hopper half, the loading vehicles being emptied of paving material into the hopper half located behind the particular vehicle. At one hopper half, loading of paving material from a loading vehicle may be carried out, while simultaneously at the other hopper half, the loading vehicle may be changed, so that sufficient material for paving may always be provided to the screed and production interruptions caused by a lack of paving material may be avoided.

The tiltability or pivotability of the bottom or base portions ensures that substantially all of the paving material in the hopper halves is supplied to the lateral conveyor devices, which convey the paving material to the longitudinal conveyor device.

In another aspect, the present invention is also a loader for pavers, which is generally similar to a paver but does not have a screed or a distributor auger, and possibly does not include a driver's cab. The longitudinal conveyor device of the loader extends beyond a rear end of the loading vehicle, in order to transfer the material conveyed by it onto a following paver and/or a separate conveyor device leading to a following paver. As all of the elements of the loader are present in the paver, there is no need for a detailed description or separate depiction of the loader, such that reference is instead made to the description below of the exemplary embodiment of a paver.

BRIEF DESCRIPTION OF THE SEVERAL VIEWS OF THE DRAWINGS

The description of the invention below will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
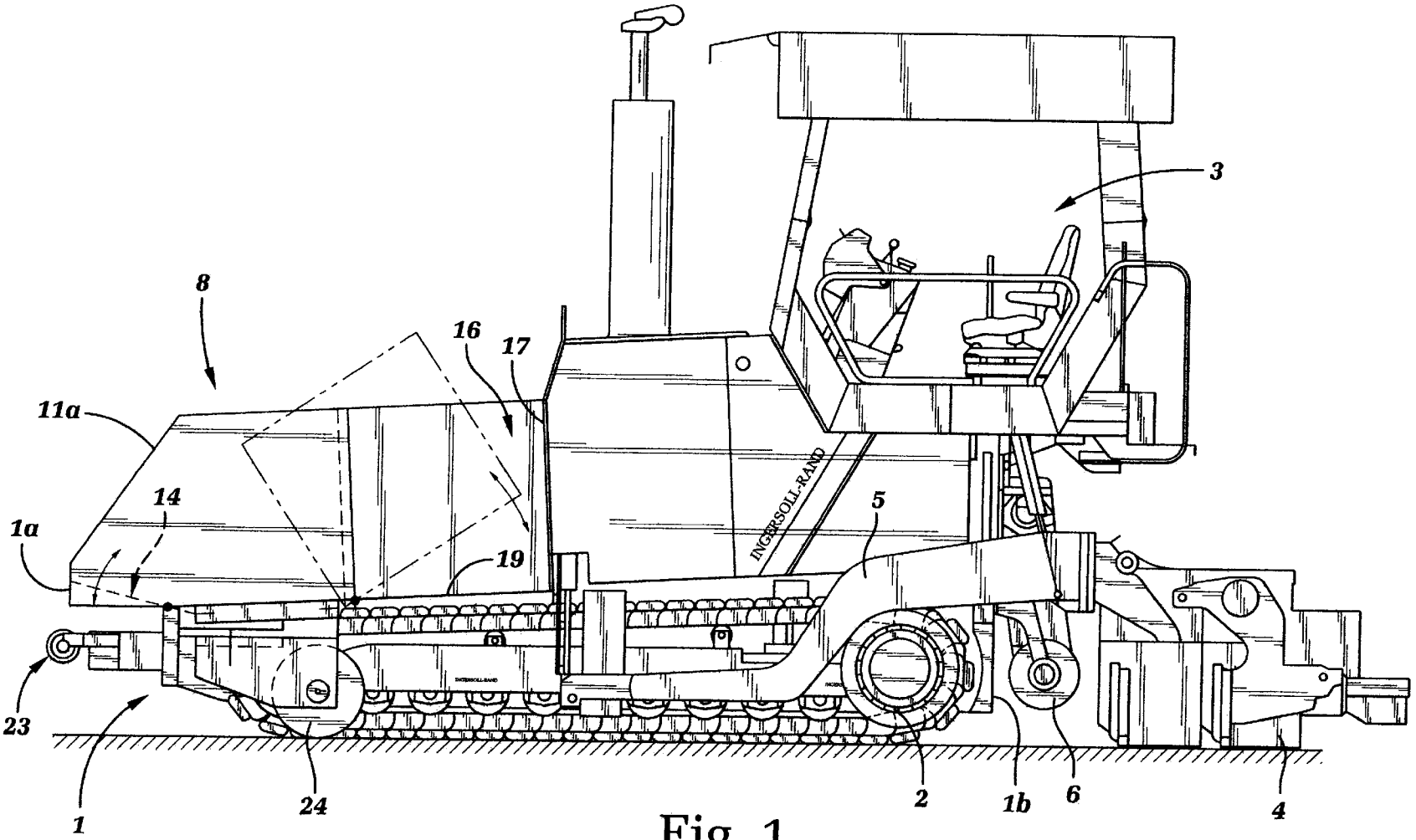
FIG. 1 shows a side elevational view of a paver.

Certain terminology is used in the following description for convenience only and is not limiting. The words "right", "left", "lower", "upper", "upward", "down" and "downward" designate directions in the drawings to which reference is made. The words "front", "frontward" and "rear", "rearward" refer to directions toward and away from, respectively, a designated front section of a paver. The words "lateral", "laterally" and "longitudinal", "longitudinally" refer to directions generally perpendicular to and generally parallel with, respectively, a designated paving direction. The terminology includes the words specifically mentioned above, derivatives thereof, and words of similar import.

Figure 2:
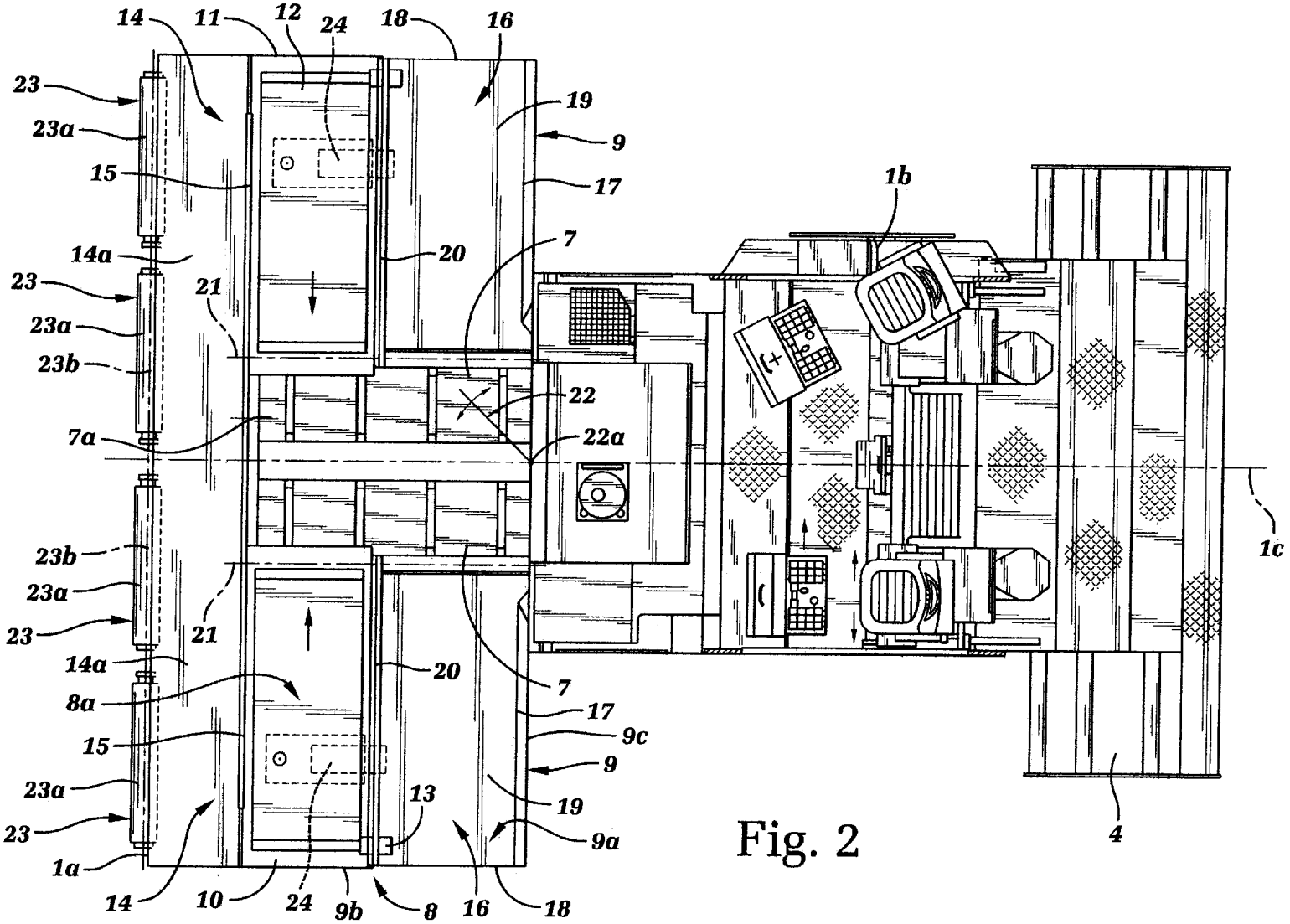
FIG. 2 is a top elevational view of the paver of FIG. 1.

Referring now to the drawings in detail, wherein like numbers are used to indicate like elements throughout, there is shown in FIGS. 1 and 2 a presently preferred embodiment of a paver in accordance with the present invention. The paver comprises a chassis 1 having steerable traveling gear or locomotion means 2, preferably two wheel trains driving a continuous track or crawler, although separate wheels may be used. The paver has a driver's cab 3 from which the paver can be operated. A screed 4 is disposed at the rear of the paver, i.e., with respect to the paving direction, which floats on material to be paved and is articulated on or movably connected with the chassis 1 by a pair of tension arms 5.

A distributor auger 6 is located in front of the screed 4 (and behind the chassis 1) which distributes paving material across the width of the screed 4. A longitudinal conveyor device 7 supplies paving material to the distributor auger 6. The conveyor device 7 is located centrally in the chassis 1 and extends along a chassis central axis 1*c* and between the front and rear ends 1*a*, 1*b*, respectively, of the chassis 1 and beneath the driver's cab 3. Preferably, the longitudinal conveyor device 7 comprises two parallel conveyors and extends into a hopper 8 located at the front end 1*a* of the paving machine. Most preferably, the two conveyors are each continuous belt type of conveyor having an endless belt made of an appropriate material, such as for example rubber sheets or connected metal plates, disposed about a series of rollers and driven by appropriate means, such as by means of one or more electric motors (not shown) connected with a drive roller. However, it is within the scope of the present invention for the conveyor device 7 to be any other appropriate type of conveyor device.

The hopper 8 basically comprises two hopper halves 9, each with a generally horizontal bottom or base portion 9*a* and generally vertical sidewall 9*b* and rear wall 9*c*. The rear wall 9*c* of each hopper half 9 is spaced from the other rear wall 9*c* such that the longitudinal conveyor device 7 extends between the rear walls 9*c* so as to be disposed between the two hopper halves 9.

More specifically, the hopper halves 9 each include a central section 10 having a generally vertical side-wall portion 11 that has a front edge 11*a* that is angled or slanted in the paving direction so as to correspond to the maximum tipping angle of a loading vehicle. A transversely-extending or lateral conveyor device 12 extends across the bottom portion of each central section 10 between the outer lateral side of the respective hopper half 9 (i.e., from proximal to sidewall 11) and the front end 7*a* of the longitudinal conveyor device 7. Preferably, each lateral conveyor device 12 is a "belt" or "belted" type of conveyor having a continuous belt disposed about and guided by rollers and driven by a drive device 13, such as for example an electric or hydraulic motor configured to rotate a drive roller. The lateral conveyor 12 transport paving material disposed within the respective hopper half 9 to the longitudinal conveyor device 7. Preferably, the two lateral conveyor devices 12 are drivable alternately according to a measurement of vertical load on the hopper halves 9. In other words, only the lateral conveyor 12 of the hopper half 9 in which a load of paving material is detected, using appropriate sensor means, will be driven. The lateral conveyors may be controlled manually by the paver operator or automatically by means of an appropriate sensors and control system (not depicted) incorporated with each lateral conveyor 12.

Each hopper half 9 further includes a front section 14, preferably formed of a base plate 14*a*, rotatably attached to the front edge of the central section 10 and extending generally horizontally and laterally between the sidewall portion 11 and the central axis 1*c* of the chassis 1. More specifically, the two front sections 14 extend transversely with respect to the paving direction over about half the width of the hopper 8 and are mounted to the central section 10 in an articulated or pivotable manner about an axis 15 that extends adjacent to the proximal lateral conveyor device 12. Each front section 14 is capable of being pivoted upwardly and generally rearwardly toward the adjacent lateral conveyor device 12 and, thus also towards the front end 7*a* of the longitudinal conveyor device 7, preferably by means of one or more hydraulic cylinders (not depicted) extending between the chassis 1 and the respective front section 14.

When either one of the front sections 14 is pivoted upwardly (and rearwardly) toward the adjacent lateral conveyor 12, any paving material disposed on the front section 14 is deposited onto the particular lateral conveyor device 12 and/or onto the longitudinal conveyor device 7. Preferably, the front sections 14 are each connected with the adjacent central section 10 of the hopper half 9 so as to be located higher than or above the associated lateral conveyor devices 12, as best shown in FIG. 1, so that all the paving material located on or in the front sections 14 are emptied or deposited onto the conveyor devices 7, 12.

Furthermore, each hopper half 9 also includes a rear section 16 located rearwardly of or behind the central section 10 with respect to the paving direction. Each rear section 16 includes a generally vertical rear wall portion 17 (providing the rear wall 9*c* of the particular hopper half 9), a generally vertical sidewall portion 18 and a generally horizontal bottom or base portion 19. The front edge of each base portion 19 is rotatably attached to the rear horizontal edge of the adjacent central section 10 so that each rear section 16 is thereby mounted in an articulated or pivotable manner to the particular central section 10. The rear sections 16 are pivotable about a lateral horizontal axis 20 that extends adjacently to the respective lateral conveyor device 12 and are each capable of being separately pivoted upwardly and generally frontwardly toward the proximal lateral conveyor device 12, preferably by means of one or more hydraulic cylinders (not depicted). When a rear section 16 is pivoted upwardly (and frontwardly) toward the adjacent lateral conveyor 12, any paving material disposed in the rear section 16 is substantially completely evacuated from the rear section 16 and is deposited onto the proximal or adjacent lateral conveyor device 12.

Preferably, each hopper half 9 is mounted on the chassis 1 in an articulated manner about a longitudinally-extending horizontal axis 21 located adjacent or proximal to the longitudinal conveyor device 7. Thus, each hopper half 9 is therefore capable of being pivoted upwardly in a lateral direction generally toward the central axis 1*c* of the chassis 1, preferably by means of one or more hydraulic cylinders (not depicted) extending between the central section 10 of the particular hopper half 9 and the chassis 1. The ability to pivot each hopper half 9 laterally (i.e., alternately in directions between a lateral side of the paver and the central axis 1*c*) enables the hopper halves 9 to be pivoted upwardly to an essentially vertical storage position (not shown). The hopper 8 is mounted on the chassis 1 so as to be located at a sufficient height above a grade surface being paved (or another surface, such as a roadway) so that when the two hopper halves 9 are each pivoted upwardly into the storage position, the hopper bottoms 9*a*, particularly the inner longitudinal edges thereof, do not come into contact with the grade or base surface.

With the two hopper halves 9 each being located in the upper storage position as described above, the overall width of the paver is significantly reduced, which is beneficial for purposes of transporting the paver when not in use. Further, as the lateral conveyor devices 12 do not extend across the entire width of the hopper bottom 8*a*, but extend only across the central section 10 of one hopper half 9, each lateral conveyor 12 and associated drive 13 form a relatively small, compact and correspondingly lightweight unit.

Preferably, the paver further includes a movable guide plate 22 located above the longitudinal conveyor device 7 and which is pivotable about a vertical axis 22*a* located centrally of the conveyor 7 and between the inner ends of the rear wall portions of the hopper 8. Preferably, the guide plate 22 is pivotable by means of a hydraulic cylinder (not depicted). The guide plate 22 may be positioned at various angular orientations with respect to central axis 1*c* of the chassis 1. By positioning the plate 22 in a proper orientation, it is possible to ensure that paving material is distributed as uniformly as possible over the width of the longitudinal conveyor device 7. Preferably, depending on which lateral conveyor device 12 is in operation at a particular point in a paving operation, the pivotable guide plate 22 is automatically moved in the direction required to direct paving material from the particular lateral conveyor 12 to the longitudinal conveyor device 7.

The hopper 8 preferably further includes two rotatable contact members 23 arranged transversely across the front end la of the chassis 1 and mounted to the hopper 8 beneath the front section 14 of a separate hopper half 9. Each contact member 23 preferably includes a pair of rollers 23*a* that are each rotatable about a common axis 23*b* extending between the rollers 23*a*. During a paving operation, a loading vehicle reversing towards one of the hopper halves 9 of the paver moves into contact with the contact member 23 of the respective hopper half 9, rather than with the hopper half 9 itself, and then loading of the hopper 8 may commence. The contact members 23 are each pivotable upwardly with the associated hopper half 9 for transport purposes.

Preferably, the hopper 8 further includes two supporting wheels 24 rotatably mounted beneath the central section 14 of each hopper half 9 so as to be disposed below the associated lateral conveyor device 12. Each supporting wheel 24 supports the associated hopper half 9 so as to ensure statically satisfactory vertical-load conditions on the base surface or pavement substrate and preferably have trailing properties. The supporting wheels 24 may be provided with separate drive means to rotate the wheels 24 (not shown) or may be regulatable in a load-dependent manner dependent on the torque applied to the wheels 24.

If the hopper halves 9 are not provided with a stop means to limit the downward rotational movement of the hopper half 9 about the associated axis 21 to prevent the outer lateral edges of the hopper 8 from contacting the pavement substrate, the supporting wheels 24 are able to provide satisfactory support and vertical-load conditions for the hopper 8, even if there is unevenness in the pavement substrate.

Alternatively, crawlers (not depicted) may be used instead of the supporting wheels 24. Further, the hopper 8 may also include one or more a traveling gears or locomotion means, such as for example supporting rollers, wheels or crawlers (none depicted), preferably connected with and extending below the underside of the hopper 8, so that the hopper 8 may be transported as a separate unit independently of the paver.

In use of the paver, a loading vehicle loaded with paving material is positioned in front of one of the hopper halves 9 and the paving material is emptied from the loading vehicle into the particular hopper half 9. Paving material deposited directly on the lateral conveyor 12 is conveyed to the longitudinal conveyor 7 and the front section 14 and rear section 16 of the particular hopper half 9 are each pivoted upwardly toward the central section 10 such that paving material located in the hopper half sections 14, 16 slides or falls onto the associated lateral conveyor 12 and thereafter conveyed to the longitudinal conveyor device 7. Then, the paving material is conveyed or transported by means of the longitudinal conveyor device 7 to the distributor auger 6, is distributed by the latter over the paving width and is paved by means of the screed 4.

In another embodiment, the present invention is a loader for a paving vehicle. The loader is generally identical the paver as described above, except that the loader does not include a screed or a distributor auger, and if desired, does not include a driver's cab. The longitudinal conveyor device 7 of the loader extends beyond a rear end 1*b* of the loading vehicle chassis 1, such that paving material may be conveyed by the longitudinal conveyor onto a following paver and/or a separate conveyor device leading to a following paver. The loader includes all of the other elements or components of paver, and functions generally similarly to the paver, as described above, with the following differences or modifications.

The longitudinal conveyor device 7 of the loader preferably consists of one or two continuous band type of conveyors, which may include a system to heat the conveyors (and thus the paving material) if desired for a particular application to ensure a proper temperature of the paving material. In applications where the loader transfers paving material to a following paver, the rear end 7*b* of the longitudinal conveyor 7 must extend or project a sufficient distance from the rear or discharge end 1*b* of the loader chassis 1 such that the conveyor 7 is able to convey paving material onto the loader. In applications where the loader transfers paving material onto a separate or intermediate conveyor (not shown) that transfers the paving material to a paver, the conveyor 7 may be made with a shorter length projecting from the rear, discharge end 1*b* of the chassis 1.

Further, the hopper 8 of the loader may be provided with a partition (not shown) extending centrally and longitudinally in the direction of loading and with two conveyors, preferably continuous band conveyors, each disposed on an opposing side of the partition. With such a hopper structure, the loader may be loaded with two different types of paving materials, for example one material mix for a binder course and another material mix for a wearing course, such that the two materials are separately discharged to or loaded onto two different pavers or paving assemblies. When using the loader with two different materials, paving materials are each deposited into a separate one of the hopper halves from a different loader vehicle, such that the different materials are not conveyed by the same conveyor 7 and mixing of the materials is thereby avoided. The paving materials may be supplied directly to a following paver by means of one or more continuous band conveyors 7 on the loader that each have an appropriate length or, if the paver is located a substantial distance behind the loader, by means of an separate, intermediate conveyor. The one or more conveyors of the longitudinal conveyor device 7 may be vertically adjustable and/or laterally pivotable on the discharge side (i.e., at the chassis rear end 1*b*) in order to ensure that the loader may be adjusted for use with different types and/or sizes of paving machines and/or intermediate conveyors.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

Having described the invention, what is claimed is:

1. A paver with a chassis (1) having front and rear ends with respect to a paving direction, a removable hopper (8) for receiving material to be paved disposed at the front end of the chassis (1), a floating screed (4) connected with the rear end of the chassis (1), a distributor auger (6) disposed in front of the screed (4), a longitudinal conveyor device (7) provided between the hopper (8) and the distributor auger (6), the hopper (8) being open towards the longitudinal conveyor device (7) and comprising two hopper halves (9) which are each pivotable about an axis (21) running adjacently to the longitudinal conveyor device (7) in the paving direction, wherein a lateral conveyor device (12) is disposed on a separate bottom portion (9*a*) of each one of the hopper halves (9), each lateral conveyor device (12) being drivable by a separate drive (13), each lateral conveyor device (12) extending to the longitudinal conveyor device (7) and being configured as a belt conveyor, the bottom portion (9*a*) of each hopper half (9) including movable base portions (14*a*, 19) disposed adjacent to the lateral conveyor device (12)

disposed within the hopper half (9), the movable base portions (14*a*, 19) being tiltable relative to the lateral conveyor device (12), the lateral conveyor devices (12) being pivotable together with the hopper halves (9).

2. The paver according to claim 1, wherein each hopper half (9) has a rear hopper section (16) which includes a rear movable base portion (19) of the hopper bottom portion (9*a*), the rear hopper half (16) being pivotable forwardly about an axis (20) extending adjacently to the lateral conveyor device (12) disposed within the hopper half (9) in a direction of transport of the conveyor device (12).

3. The paver according to claim 1, wherein each hopper half (9) includes a front base plate (14*a*) pivotable rearwardly about an axis (15) extending adjacently to the lateral conveyor device (12) disposed within the hopper half (9) in a direction of transport of the conveyor device (12).

4. The paver according to claim 1, wherein the base portions (14, 19) of each of the hopper halves (9) are each actuated by at least one, separate hydraulic cylinder.

5. The paver according to claim 1, wherein the longitudinal conveyor device (7) comprises a guide plate (22) pivotable about a fixed vertical axis above the upper surface of the longitudinal conveyor device (7).

6. The paver according to claim 1, wherein the longitudinal conveyor device (7) comprises two parallel conveyors.

7. The paver according to claim 1, wherein at least one traveling gear (24) is arranged on each of the hopper halves (9) below the lateral conveyor devices (12).

8. The paver according to claim 7, wherein each of the traveling gears (24) has trailing properties.

9. The paver according to claim 7, wherein each of the traveling gears (24) has a drive unit configured to drive the traveling gear (24).

10. The paver according to claim 9, wherein the traveling gears (24) are regulatable in a load-dependent manner in terms of their torque.

11. The paver according to claim 7, wherein the traveling gears (24) each comprise at least one supporting wheel.

12. The paver according to claim 7, wherein the traveling gears (24) each comprise at least one crawler traveling gear.

13. The paver according to claim 7, wherein the paver includes hopper carrier structure and the hopper halves (9) are each mounted in an articulated manner an the hopper carrier structure about an axis (21) extending adjacently to the longitudinal conveyor device (7) in the paving direction.

14. The paver according to claim 1, wherein the hopper halves (9) are in each case pivotable upwards in a transport position about an axis (21) extending adjacently to the longitudinal conveyor device (7) in the paving direction.

15. The paver according to claim 1, wherein the lateral conveyor devices (12) are alternately drivable according to a measurement of vertical load.

16. The paver according to claim 15, wherein the longitudinal conveyor device (7) includes a guide plate (22) pivotable about a fixed vertical axis above an upper surface of the conveyor device (7), the pivotable guide plate (22) being automatically deflectable in a direction toward one of the two lateral conveyor devices (12) dependent upon which conveyor device (12) is in operation.

17. The paver according to claim 1, wherein the hopper (8) is arranged removably as a unit on the paver.

18. The paver according to claim 17, wherein a contact member (23) for bearing against a rear side of a loading vehicle is arranged in front of each of the two hopper halves (9).

19. A loader for pavers, with a chassis (1) having front and rear ends with respect to a paving direction, a removable hopper (8) for receiving material to be paved disposed at the front end of the chassis (1) a longitudinal conveyor device (7) disposed rearwardly of the hopper (8) and extending beyond the rear end of the chassis (1), the hopper (8) being open towards the longitudinal conveyor device (7) and comprising two hopper halves (9), each hopper half (9) having a bottom portion (9*a*) and a lateral conveyor device (12) disposed on the bottom portion (9*a*), wherein the longitudinal conveyor device (7) has a loading end disposed between the hopper halves (9) the lateral conveyor devices (12) are each belt conveyor devices which extend to the longitudinal conveyor device (7), the bottom portion (9*a*) of each hopper half (9) including base portions (14*a*, 19) disposed adjacent to the lateral conveyor device (12) of the hopper half (9) and being tiltable relative to the lateral conveyor device (12), and each lateral conveyor device (12) being pivotable, together with the hopper halves (9), about an axis (21) extending adjacently to the longitudinal conveyor device (7) in the paving direction.

20. The loader according to claim 19, wherein the longitudinal conveyor device (7) comprises one or two continuous band conveyors.

21. The loader according to claim 19, wherein the hopper (8) has a central longitudinal partition having two opposing sides and the loader has two longitudinal conveyor devices (7), each longitudinal conveyor device (7) being disposed on an opposing side of the partition, and at least one of the two longitudinal conveyors (7) being laterally pivotable on a discharge side of the one conveyor (7).

* * * * *